US006098803A

United States Patent [19]

Tanaka et al.

[11] Patent Number: 6,098,803

[45] Date of Patent: Aug. 8, 2000

[54] ROD TRANSPORT CONTAINER

[75] Inventors: Nobuo Tanaka; Katuei Yokota; Hiroshi Nakatui, all of Tokyo, Japan

[73] Assignee: Zeon Kasei Co., Inc., Tokyo, Japan

[21] Appl. No.: 09/253,770

[22] Filed: Feb. 22, 1999

[30] Foreign Application Priority Data

Feb. 23, 1998 [JP] Japan ..... 10-057436

[51] Int. Cl.[7] ..... B65D 85/20

[52] U.S. Cl. ..... 206/443; 206/446; 206/386

[58] Field of Search ..... 206/443, 446, 206/386, 391, 393, 394, 412, 600; 211/59.4, 60.1

[56] References Cited

U.S. PATENT DOCUMENTS

| | | | |
|---|---|---|---|
| 2,990,951 | 7/1961 | Fallert | 206/443 |
| 3,196,229 | 7/1965 | Glass | 206/443 |
| 4,706,822 | 11/1987 | Remp, Jr. et al. | 206/443 |
| 5,161,703 | 11/1992 | Patton | 206/446 |
| 5,516,244 | 5/1996 | Baka | 206/443 |
| 5,649,632 | 7/1997 | Terashima et al. | 211/59.4 |

*Primary Examiner*—Luan Bui

*Attorney, Agent, or Firm*—Armstrong, Westerman, Hattori, McLeland & Naughton

[57] ABSTRACT

Disclosed is a rod transport container. The container comprises a first partition member and a second partition member removably insertable into said container. The first partition member incorporates one or more first layer lower support cutouts for supporting a lower circumference of one or more first layer rods loaded within the container. The second partition member incorporates one or more first layer upper support cutouts for supporting an upper circumference of one or more of the first layer rods. The first partition member and the second partition member are removably inserted into the container in mutually offset positions along the longitudinal direction of the rods to be loaded within said container. The rod transport container is capable of securely supporting rods of various diameter through a mechanism comprised only of oppositely facing offset partition members which fixedly maintain the lower and upper circumference of the rods through a wedge-type support structure, thus preventing the movement of the rods within the container.

16 Claims, 6 Drawing Sheets

ROD TRANSPORT CONTAINER

BACKGROUND OF THE INVENTION

1. Field of the Invention

The present invention relates to a rod transport container for transporting rod-shaped products of various diameter.

2. Description of the Related Art

Conventional containers utilized for transporting monocrystalline silicon rods and other like products commonly utilize trays comprised of cardboard or thick paper, said trays incorporating partition walls between which the silicon rods are placed. The trays are then stacked vertically within the cardboard or heavy paper product container for transport. Moreover, various types of shock absorbent materials are also often placed in the container.

The conventional container, as well as the cardboard trays and shock absorbent materials enclosed therein, are normally discarded after delivery is completed, thus becoming a source of industrial waste and environmental pollution.

Moreover, in cases where the container is used to transport rods of various diameters, there is a need to fabricate trays having various diameter rods, a shortcoming which significantly increases the container manufacturing cost.

SUMMARY OF THE INVENTION

In view of the foregoing circumstance, an object of the present invention is to provide a re-usable non-disposable container capable of supporting and transporting rod-shaped products of various diameter contained therein.

To achieve the above-mentioned object, a rod transport container comprises;

- a first partition member removably insertable into said container, said first partition member incorporating one or more first layer lower support cutouts for supporting a lower circumference of one or more first layer rods loaded within said container,
- a second partition member removably insertable into said container, said second partition member incorporating one or more first layer upper support cutouts for supporting an upper circumference of one or more of said first layer rods.

The container may comprise a pair of mutually facing side plates having respectively a first slide channel and a second slide channel which are located adjacently and substantially parallel on each inner wall surface of said side plates, both ends of said first partition member being inserted into each of said first slide channels and both ends of said second partition member being inserted into each of said second slide channels.

It is preferable that the first layer lower support cutout provide at least two points of support for the lower circumference of the smallest diameter rod to be loaded within the container, and that it is formed as an upside down triangular or three-sided flat bottomed void having outwardly inclined walls.

It is preferable that the first layer upper support cutout provide at least two points of support for the upper circumference of the largest diameter rod to be loaded within the container, and that it is formed as a triangular or three-sided flat bottomed void having inwardly inclined walls.

It is further preferable that multiple first layer lower support cutouts are formed within the upper edge and along the length of the first partition member, and that multiple first layer upper support cutouts are formed within the lower edge and along the length of the second partition member oppositely facing the first layer lower support cutouts.

It is further preferable that second layer lower support cutouts are formed on the upper edge of the second partition member to the same configuration as the first layer lower support cutouts.

It is preferable that the second layer lower support cutouts provide means of supporting the lower circumference of second layer rods loaded in the container, and that second layer upper support cutouts formed on a lower edge of a third partition member hold the upper circumference of the second layer rods, both ends of said third partition member being movably insertable to the pair of first slide channels. These second layer upper support cutouts are formed to the same shape as the first layer upper support cutouts.

It is preferable that third layer lower support cutouts are formed on the upper edge of the third partition member to the same configuration as the first layer lower support cutouts.

It is preferable that the third layer lower support cutouts support the lower circumference of a third layer rod. The upper circumference of the third layer rods are held by third layer upper support cutouts formed within a fourth partition member whose both ends are movably inserted to the pair of second slide channels positioned above the second partition member. Preferably, the third layer upper support cutouts are of the same configuration as the first layer upper support cutouts.

It is preferable that the partition members contacting each rod from upper and lower direction are inserted to and supported by mutually different slide channels so that each rod is supported by the different positioned partition members in the longitudinal direction of the rod.

The partition members are preferably comprised of a shock absorbent material.

A securing device may be removably installed within the first and/or second slide channels for fixedly securing the topmost partition member to the container after the desired number of rods have been loaded.

It is preferable that multiple locking orifices are provided at the upper vicinity of the first and/or second slide channels and are located and spaced in relation to the diameters of the rods to be transported by the container, said locking orifices serving as means by which the securing device can be removably connected to the container.

It is preferable that the pair of first and second slide channels are structured as separate fixtures installable to the inner surfaces of oppositely facing walls of the container.

It is preferable that multiple pairs of first and second slide channels are installed along the length of two oppositely facing inner walls of the container at specific intervals for allowing the partition members to be selectively and removably inserted to each pair of slide channels. It is further preferable that the rods are supported by upper and lower partition members each separately residing within either the first or second pair of slide channels in mutually offset positions along the longitudinal direction of the rods.

The floor of the container may be constructed as a pallet-type structure for allowing the container to be lifted and transported by a forklift vehicle.

The side walls of the container may be constructed as a collapsible and/or deconstructive design.

In accordance with the container of the present invention, rod-shaped products can be safely and securely maintained in position during their transport, and the container can be reduced in size and returned to the original point of transportation for re-use, thereby significantly reducing industrial waste and contributing to a preferable environment.

Specifically, as the container walls are of a collapsible and/or deconstructive design, the container can be returned in a more compact size than its loaded condition, thus reducing return transportation costs.

Moreover, in the container of the present invention, the partition members are able to support rods of various diameter through the offset positioning of the partition members along the axial length of the rods. As a result, this structure allows the rods in the container to be safely and securely supported, even in cases where rods of various diameter are loaded in the same container, at their upper and lower circumference between oppositely facing and offsetly positioned partition members. Note that the vertical positions of the partition members in the container vary in accordance with the diameters of the rods to be loaded in the container.

BRIEF DESCRIPTION OF THE DRAWINGS

Other objects and features of the present invention will be described in detail with reference to accompanying drawings, in which.

DESCRIPTION OF THE PREFERRED EMBODIMENTS

Figure 1:
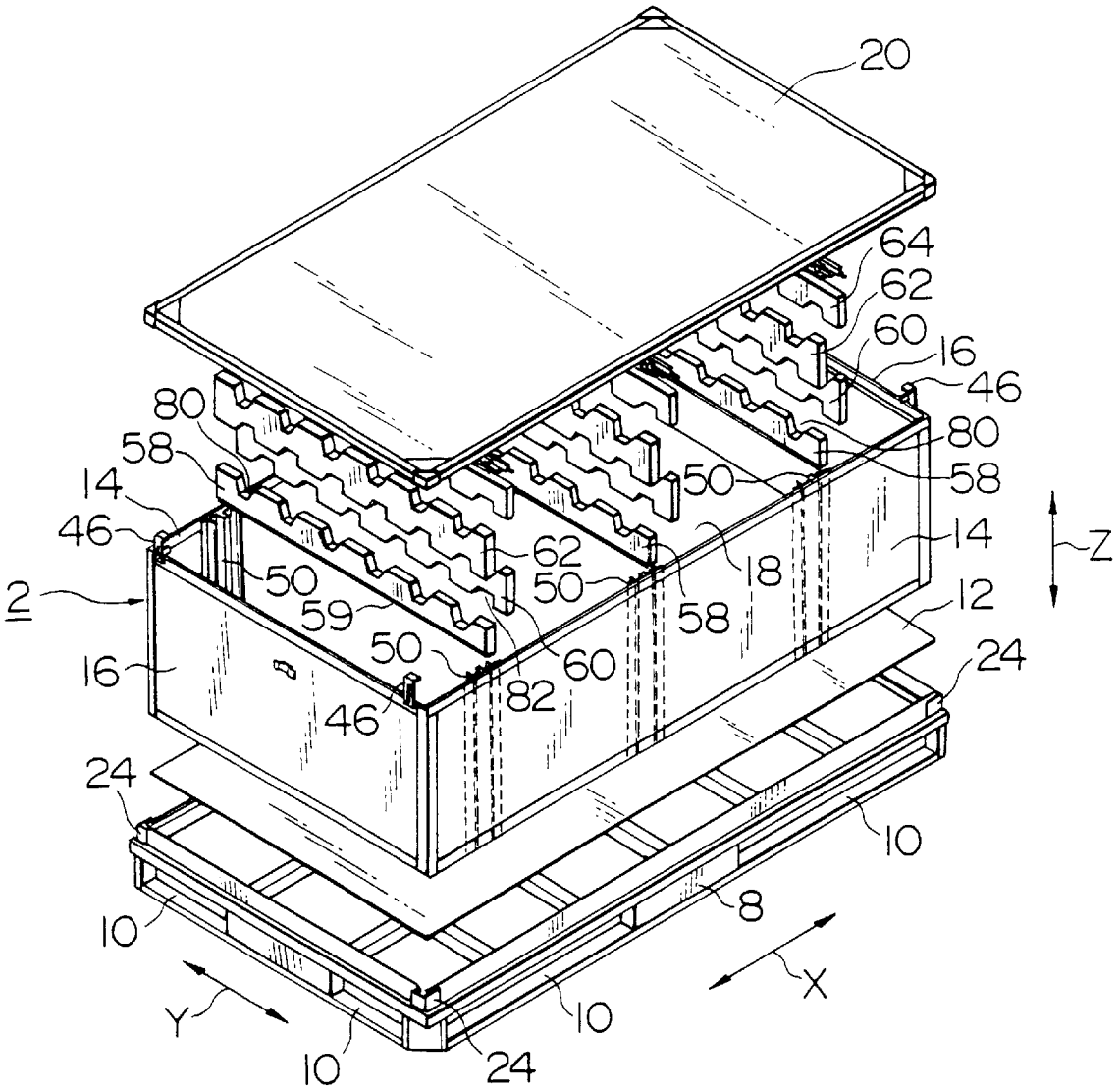
FIG. 1 is an exploded perspective view of a container of an embodiment of the present invention.
Figure 6:
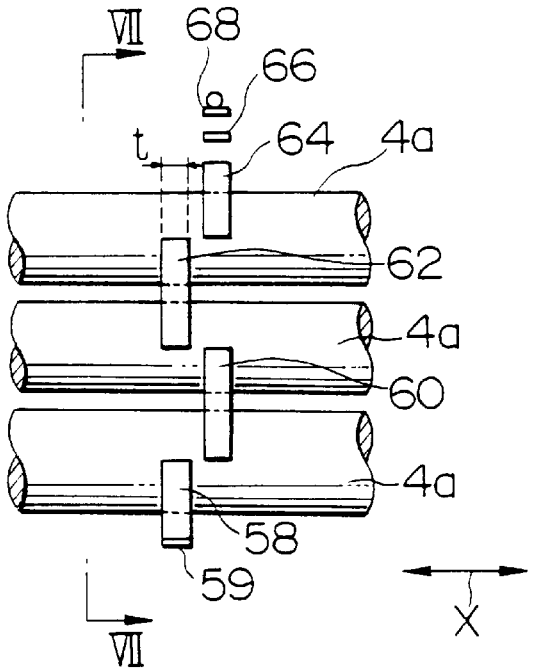
FIG. 6 shows the relationship between the partition member and rods of relatively large diameter.
Figure 8:
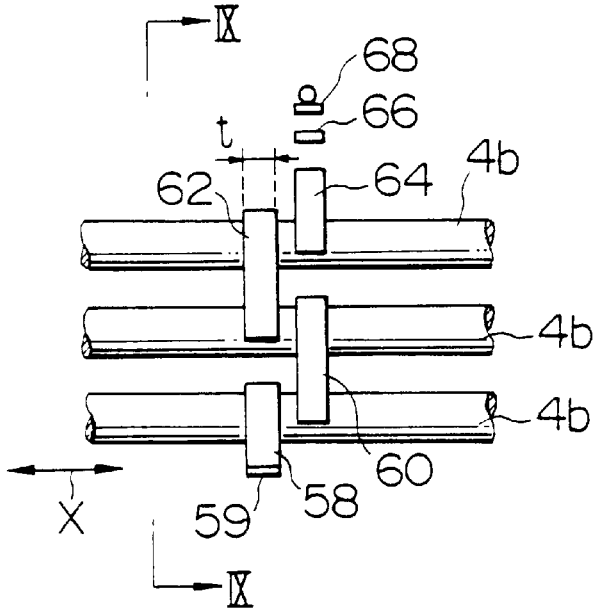
FIG. 8 is a side view showing the relationship between the partition members and rods of relatively small diameter.

As shown in FIG. 1, a container 2 of the present embodiment has a pallet 8 on the floor and is utilized for transport of monocrystalline silicon semiconductor rods 4*a* and 4*b* shown in FIGS. 6 and 8. Lift openings 10 are provided in the pallet 8 for allowing the container to be lifted by a forklift vehicle. Pallet 8 is preferably constructed of stainless steel but may also be of a plastic or wood-based material.

Floor piece 12, comprised of a wooden composite or other material, is positioned on pallet 8. A pair of fist side walls 14 are removably installed to opposing sides of pallet 8 in opposite and approximate parallel orientation, and a pair of second side walls 16 are likewise removably installed to the two remaining opposing sides of pallet 8 and further removably connected to both sides of each of first side walls 14. In this embodiment, the first side walls 14 are installed to pallet 8 in approximate parallel alignment to the longitudinal direction 'X' of rods 4*a* and 4*b*, and second side walls 16 are installed to pallet 8 in the direction 'Y' at approximate right angles to the longitudinal direction 'X' of rods 4*a* and 4*b*. Moreover, this embodiment depicts first side walls 14 as having a slightly larger width dimension than second side walls 16.

Rods 4*a* and 4*b* are supported over the pallet 8 within internal space 18 which is defined by first and second side walls 14 and 16 respectively. A rectangular cover 20 is installed removably to the upper ends of side walls 14 and 16 for closing internal space 18.

In this embodiment, the first side walls 14 and the second side walls 16 are respectively constructed of a single composite wooden panel which, as will be presently explained, may mount to pallet 8 as a foldable structure thereon.

Figure 2:
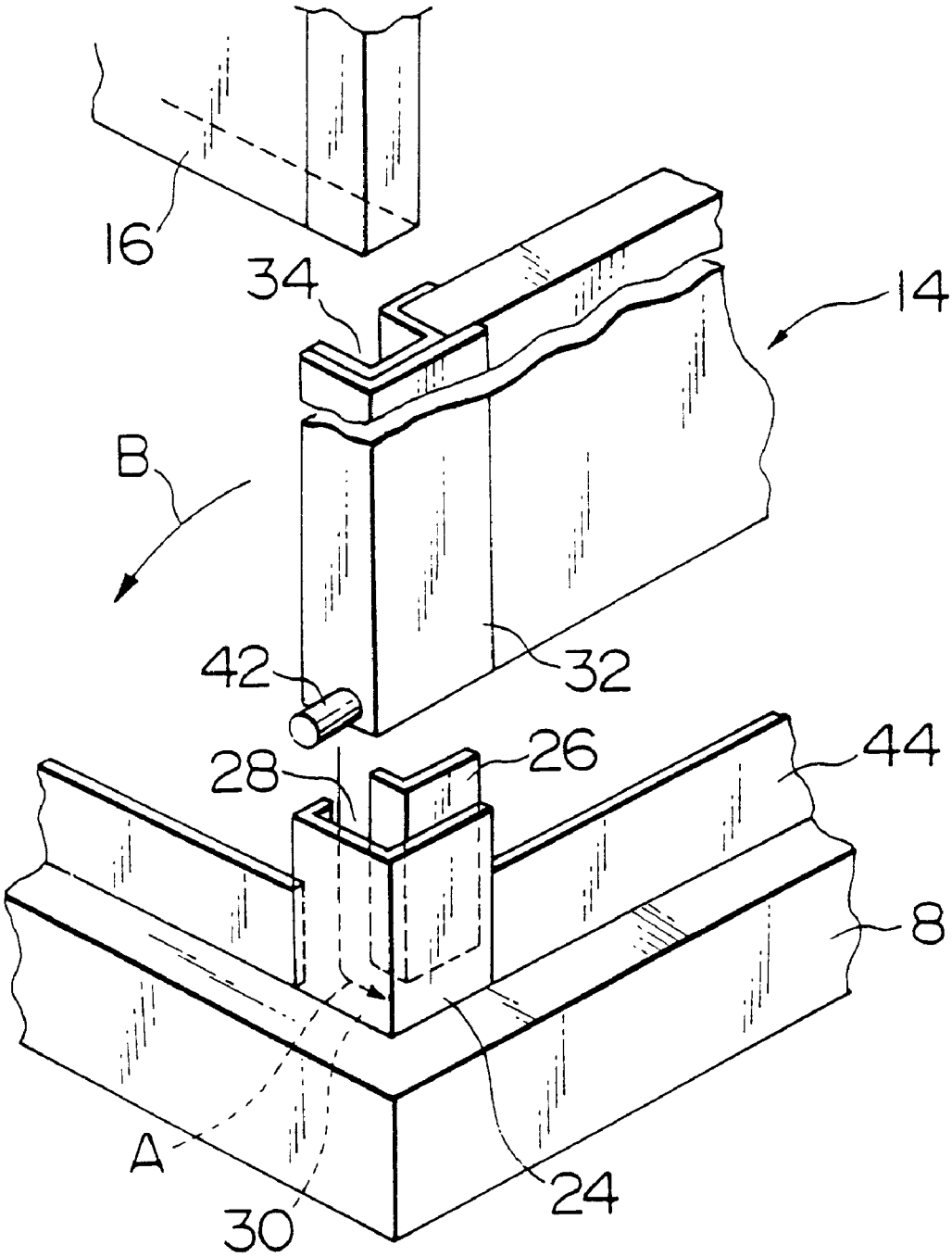
FIG. 2 is an exploded perspective view of the side wall shown in FIG. 1 and the structure through which said side wall part is attached to a pallet-type bottom part.

As shown in FIG. 2, a lower support fixture 24 is fixedly installed as an integral component of pallet 8 and to each corner thereon. An engagement piece 26, L-shaped in cross section, is fixedly attached to the inner surface of each support fixture 24 for forming vertical channel 28 and horizontal channel 30, said channel 30 forming a horizontal continuation of channel 28 beneath the engagement piece 26.

Side support brackets 32 of metal are vertically installed to both sides of the first side walls 14, and incorporate slide way 34 respectively into which both ends of second side walls 16 are inserted (FIG. 1). Moreover, pivot pin 42 is fixedly installed at the lower edge of the side support bracket 32. Each side support bracket 32 also reinforces the first side wall 14.

As shown in FIG. 2, when the pivot pin 42 is completely inserted into vertical channel 28, it will then move in a horizontal direction into the horizontal channel beneath the engagement piece 26 (direction 'A' in FIG. 2), thus preventing the pivot pin 42 from moving upward. It provides a locking mechanism which prevents each first side wall 14 from separating from pallet 8, but which also allows each first side wall 14 to pivot in the direction shown by arrow 'B'. Each side wall 14 is prevented from swinging in an outward direction by contact with the lower support fixture 24, engagement piece 26, and stripe fixture 44. Moreover, as shown in FIG. 1, pivotal attachment fixtures 46 are installed to both upper ends of the second side wall 16, and prevent the first side wall 14 from moving outwardly by removably attaching to both upper ends of the first side wall 14.

In this embodiment, the first side walls 14 and second side walls 16 can be of a folding and/or deconstructive design and still remain removably attachable to pallet 8 through the mechanism explained above.

This embodiment describes a structure whereby both ends of each second side wall 16 slide and insert to the slide channel 34 on the first side wall 14, thus allowing the second side wall 16 to be removably attached and assembled to the pallet 8 and first side wall 14.

In this embodiment, each of the first side walls 14 and the second side panels 16 as being comprised of wooden panels, the thickness of said panels preferably being from 5 to 15 millimeters, or from 8 to 10 millimeters. Furthermore, it is preferable that the edges of each of the panels are reinforced through the use of a frame. Moreover, it is preferable that both surfaces of each panel are covered with a vinyl chloride or resin film.

As shown in FIG. 1, this embodiment presents a structure whereby guide channel fixtures 50 are installed to the inner surfaces of each first side wall 14 in the longitudinal direction 'X' at specific intervals and on both inner wall surfaces at oppositely facing positions. This particular embodiment shows guide channel fixtures 50 installed at three points on each side wall 14 in the longitudinal direction 'X' of each side plate 14.

Figure 3:
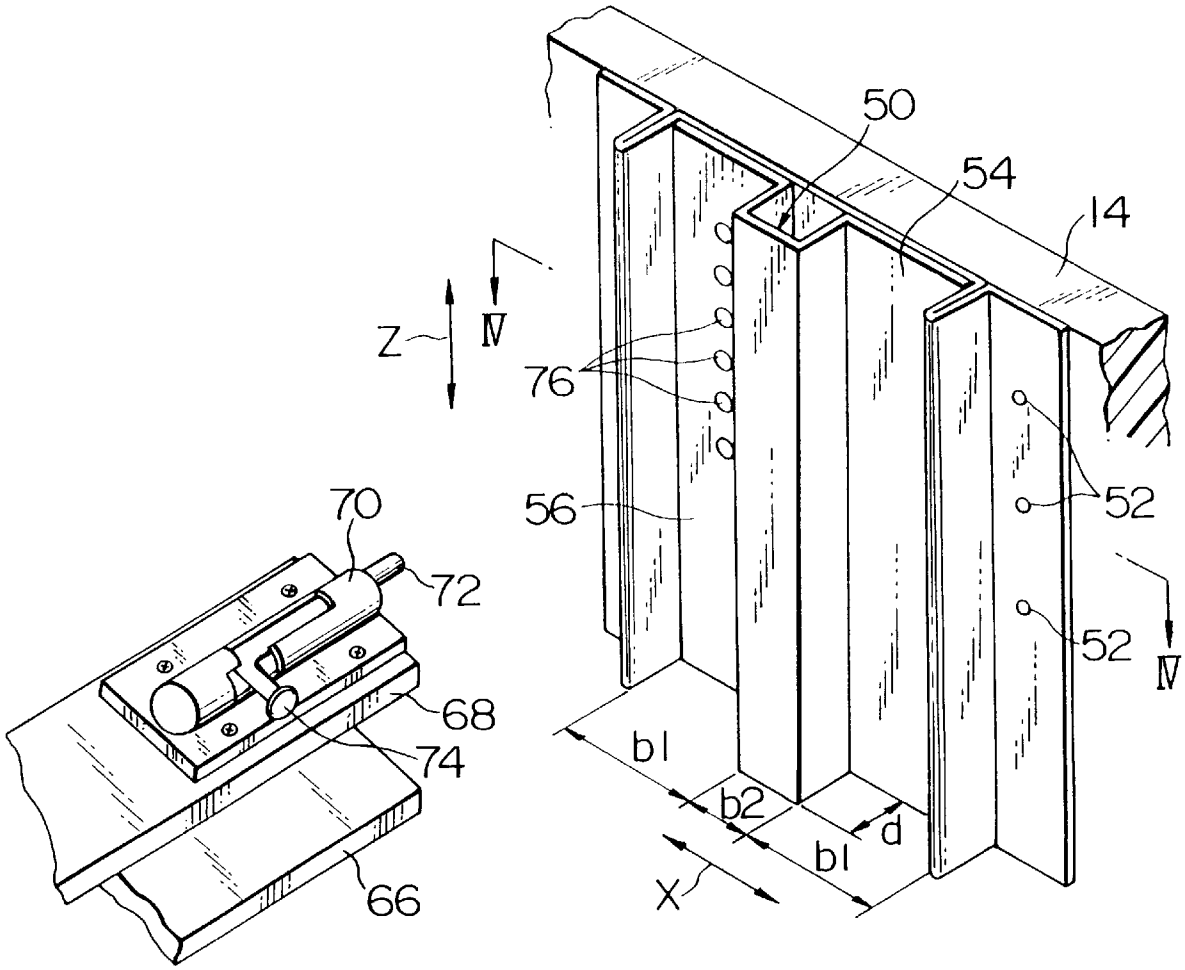
FIG. 3 is a detailed perspective view of the inner surface of the side wall of the FIG. 1 showing the relationship between the slide channel fixture and securing device attached thereto.
Figure 4:
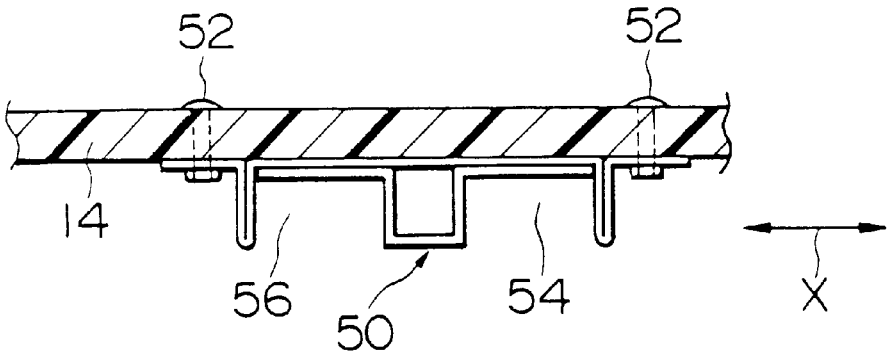
FIG. 4 is a cross sectional view through line IV—IV of FIG. 3, FIGS. 5A and 5B show respective configurations of the lower and upper support cutouts formed in the partition members.

As shown in FIGS. 3 and 4, each guide channel fixture 50 may be secured to each inner wall 14 through bolts, rivets, screws, or other fasteners 52, and include first slide channel 54 and the second slide channel 56. The first slide channel 54 and the second slide channel 56 extend substantially parallel along the 'Z' direction and mutually adjacent in the 'X' direction. The fixture 50 may be fabricated from a single or multiple pieces of sheet metal bent into the desired configuration and to a height approximately equal to that of side wall 14.

As shown in FIGS. 1, 6, 7, and 8, first partition member 58 and third partition member 62 are movably inserted to the first slide channel 54; and second partition member 60 and fourth partition member 64 to second slide channel 56 in the vertical direction 'Z'. The slide channels 54 and 56, which are integrally formed within guide channel fixture 50, establish channel width 'b1' (shown in FIG. 3) which is of a dimension slightly larger than that of thickness 't' of the partition members 58, 60, 62, and 64 (FIGS. 6 and 8). More specifically, slide channels 54 and 56 are of a width that is from 105 to 110 percent of the partition member thickness 't'. While there is no limit to thickness 't' of the partition members 58, 60, 62, and 64 (referring to the FIGS. 6 and 8), a width of 50 to 100 millimeters is considered appropriate.

Moreover, dimension 'b2', which is formed adjacently between the first slide channel 54 and the second slide channel 56, is preferably established to a width of from 5 to 20 percent of the slide channel width 'b1'. While there is no specific limitation to depth dimension 'd' of the slide channels 54 and 56, a preferable depth would be established in the 20 to 30 mm range, and an optimum depth in a range of from 23 to 25 mm. If the depth 'd' were to become too shallow, support for the ends of members 58, 60, 62, and 64 would weaken. Conversely, if the depth 'd' were to become too deep, the capacity of the container would be reduced.

The end parts of the first partition member 58 and the third partition member 62 (FIGS. 1 and 6–8) are movably inserted to the first slide channel 54 (FIG. 3), and the end parts of the second partition member 60 and the fourth partition member 64 (FIGS. 1 and 6–8) are movably inserted to the second slide channel 56 (FIG. 3). This provides for a structure in which the first partition member 58 and the third partition member 62 can be installed in offset positions along the 'X' direction (FIG. 3) in relation to that of the second partition member 60 and the fourth partition member 64. All of the partition members come into contact with the circumference of rods 4*a* and 4*b* such as monocrystalline rods shown in FIGS. 6–9, and are preferably comprised of polypropylene foam, polyethylene foam, elastic rubber, wood, or other elastic or shock absorbent material.

Figure 7:
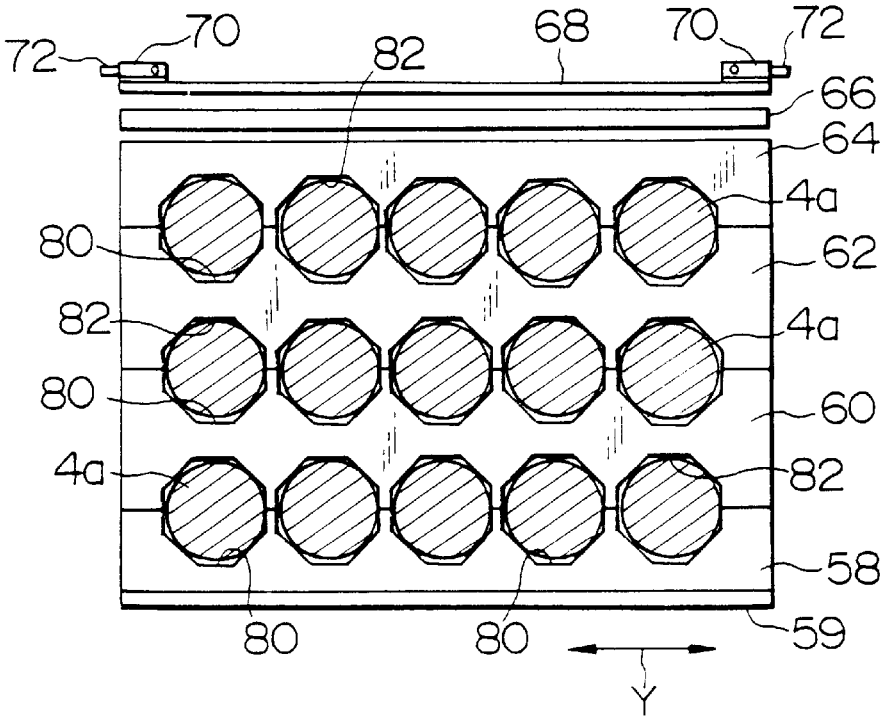
FIG. 7 is a cross sectional view through line VII—VII in FIG. 6.
Figure 9:
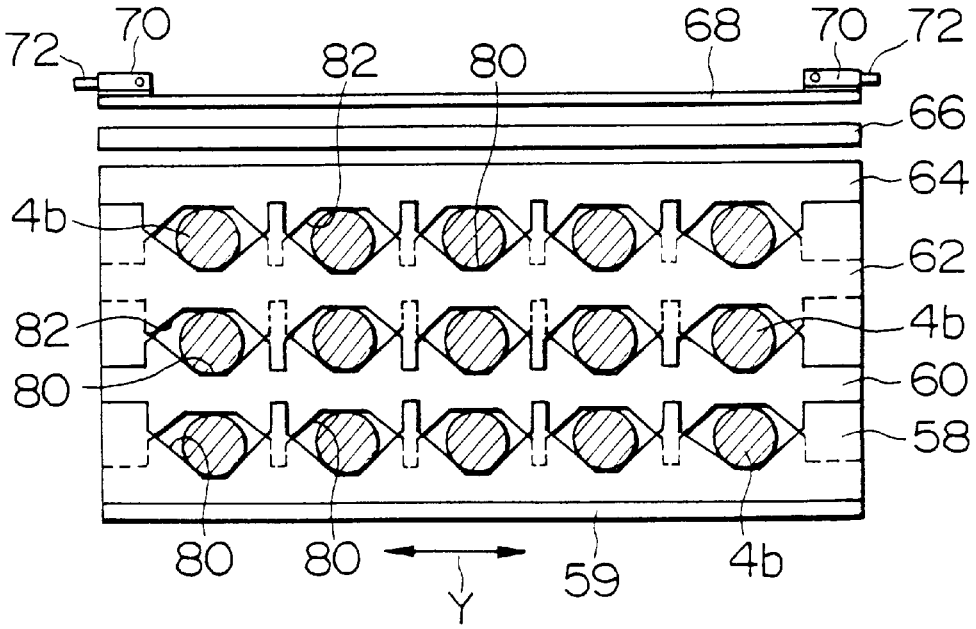
FIG. 9 is a cross sectional view through line IX—IX in FIG. 8.

As shown in FIGS. 1, 7, and 9, the first partition member 58 is installed in the first slide channel 54 (FIG. 3) at the bottom most position therein, and incorporates shock absorbent pad 59 attached to the lower edge thereon. As shown in FIG. 1, shock absorbent pad 59 comes into contact with container floor 12, said pad being comprised of polypropylene foam, polyethylene foam, wood, or other shock absorbent material for providing a cushioning effect against rods 4*a* and 4*b* which are supported between the partition members.

As is further shown in FIGS. 1, 7, and 9, first layer lower support cutouts 80 are formed at specific intervals into the upper edge of the first partition member 58 in the longitudinal direction 'Y'. The embodiment depicts multiple support cutouts 80 formed within partition member 58 in the lengthwise direction 'Y'. Each support cutout 80 is an obtuse angular cutout section resembling an inverted flat-top pyramid defined by inclined angular surfaces 80*a* (FIG. 5A) connected by a flat bottom surface. In this embodiment, the lower circumference of the smallest diameter rod 4*b* (to be transported in container 2) establishes contact with inclined surfaces 80*a* as well as with the flat bottom surface, thus forming a three-point support structure. The support cutout 80 may also be structured as a triangular cutout section, or V-shaped cutout section but in this case it would be necessary to increase the width of partition member 58 as the depth of the cutout section increases.

If the lower circumference of the smallest diameter rod 4*b* loaded into container 2 is supported between inclined surfaces 80*a*, the rod 4*b* is secured within the cutout groove in a manner which prevents the movement of rod 4*b* in the horizontal direction 'Y'. In the same manner, if the largest diameter rod 4*a* (shown in FIG. 5A as a 2-point chain line) for loading is supported between inclined surfaces 80*a* within the cutout 80, the movement of rod 4*a* in the horizontal direction 'Y' is also prevented.

The angle θ which is prescribed by inclined surfaces 80*a*, is determined by the range of the diameter of the rods to be transported within container 2. If the container is designed to carry rods of various diameters, the angle θ is preferably established from 40 to 50 degrees for preventing the various size rods from moving within the cutout sections.

The same shape of the cutout section employed for the cutout 80 is similarly formed on the upper edges of the first partition member 58, the second partition member 60, and third partition member 62.

As is further shown in FIGS. 1, 7, and 9, first layer upper support cutouts 82 are formed at specific intervals along the lower edge of the partition member 60 in the longitudinal direction 'Y', The embodiment depicts the multiple support cutouts 82 formed within partition member 60 in the direction 'Y'. Each support cutout 82 is an obtuse angular cutout section resembling a flat-top pyramid defined by inclined angular surfaces 82*a* (FIG. 5A) connected by a flat bottom surface. In this embodiment, the upper circumference of the largest diameter rod 4*a* (to be transported in container 2), contacts inclined surfaces 82*a* as well as the flat bottom surface of the cutout section, thus forming a three-point support structure. The support cutout 82 may also be structured as a triangular cutout, or V-shaped cutout sections but in this case it would be necessary to increase the width of partition member 60 as the depth of the cutout section increases.

Figure 5A:
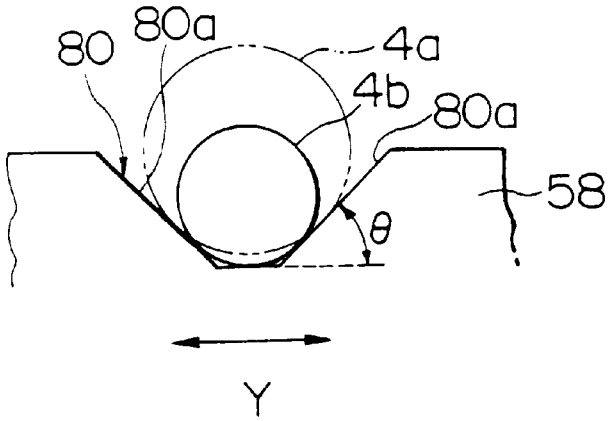
Figure 5B:
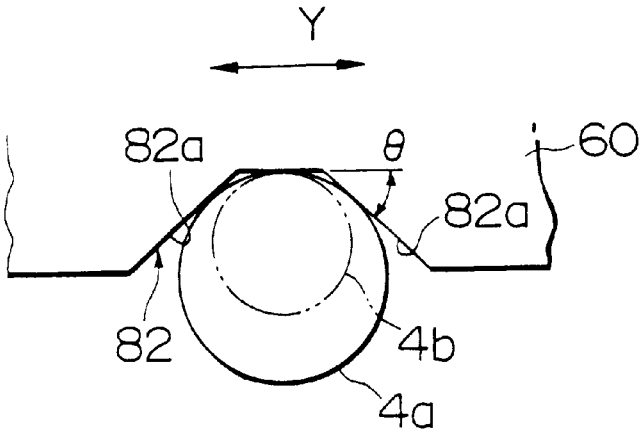

If the upper circumference of the largest diameter rod 4*a* loaded into container 2 is supported between the inclined surfaces 82*a*, the rod 4*a* is the secured within the support cutout groove in a manner which prevents the movement of the rod 4*b* in the horizontal direction 'Y'. If the smallest diameter rod 4*b* (shown in FIG. 5B as a 2-point chain line) is supported from above within the support cutout 82, the rod 4*b* does not always come in contact with the inclined surface 82*a*. However, as shown in FIG. 5A, the lower circumference of the smallest diameter rod 4*b* is supported within the lower support cutout 80, so that the movement of the rod 4*b* in the horizontal direction 'Y' is also prevented.

The inclination angle θ, which is defined by inclined surfaces 82*a*, is the approximate same the angle as the angle θ defined by the inclined surfaces 80*a* of the cutout 80.

The same type of structure employed for the cutout 82 is similarly formed into the lower edges of the third partition member 62, the fourth partition member 64, and the second partition member 60.

As shown in FIGS. 3, 7, and 9, a spacer 66 with a long and thin strip-like shape is removably installed on the flat upper surface of the fourth partition member 64, and a stopper member 68 with a long and thin strip-like shape is removably installed on the spacer plate 66. The spacer 66, which may be comprised of cardboard, styrofoam, wooden composite, plastic, or other like material, is fabricated to an appropriate thickness determined in relation to the combined installed height of the partition members 58, 60, 62, and 64. Latches 70 are installed to both extremities of the stopper member 68 in the lengthwise direction 'Y', and as shown in FIG. 3, incorporates adjuster part 74 which allows lock pin 72 to be inserted into or retracted from multiple securing orifices 76 formed in the upper area of the second slide channel 56 in the vertical direction 'Z'.

The position and spacing of securing orifices 76 are determined according to the diameter and type of rods to be loaded into the container 2. For example, as shown in FIGS. 6 and 7, in cases where maximum diameter rod 4*a* is loaded into container 2, the lock pin 72 inserts into and forms a fixed connection with the highest securing orifice 76 located at the upper area of the second slide channel 56 (shown in FIG. 3). Moreover, as shown in FIGS. 8 and 9, in cases where the minimum diameter rod 4*b* is loaded into the container 2, the lock pin 72 projects into and forms a fixed connection with the lowest securing orifice 76. Furthermore, in cases where rods having a diameter between the largest and smallest allowable diameter are loaded, the lock pin 72 inserts into and forms a fixed connection to any other appropriately positioned securing orifice 76. This structure, whereby the lock pin 72 may insert into and fixedly connect to any of a number of vertically positioned securing orifices 76, establishes a mechanism whereby maximum diameter rod 4*a* and minimum diameter rod 4*b* may both be simultaneously secured between the support cutout 80 and 82 of the partition members 58, 60, 62, and 64 as a result of the partition members being installed in mutually offset positions.

As shown in FIGS. 6–9, the first layer rods 4*a* (or 4*b*) are wedged between the support cutouts 80 and 82 of the partition members 58 and 60 respectively, the second layer rods 4*a* (or 4*b*) are wedged between the support cutouts 80 and 82 of the partition members 60 and 62 respectively, and the third layer rods 4*a* (or 4*b*) are wedged between the support cutouts 80 and 82 of the partition members 62 and 64 respectively. Rods 4*a* or 4*b* are maintained in a fixed and secured condition in the vertical direction 'Z' as a result of the wedge compression effect provided by the support cutouts 80 and 82, the support cutouts being secured in position by means of the installation of the stopper member 68 on the upper partition member 64 and the connecting of the stopper member 68 to the second slide member 56 as shown in FIG. 3. Moreover, the rods 4*a* or 4*b* are further maintained in a fixed and secured condition in the horizontal direction 'Y' through the wedge compression effect provided by the support cutouts 80 and 82.

Moreover, rods 4*a* or 4*b* are secured in position in their longitudinal direction 'X' by means of a shock absorbing pad or other like material being installed on the inner surface of each second inner wall 16. In cases where the length of rods 4*a* or 4*b* extends over only two of the three pairs of partition members shown in FIG. 1, movement of the rods in their axial direction 'X' may be prevented by the insertion of a shock absorbent pad or other like material between the remaining non-supporting partition members and the ends of rods 4*a* or 4*b*. The shock absorbent pad or other like material may consist of the same material used for spacer 66 shown in FIG. 3.

As a result of the structure specified by this embodiment, the recipient of the container 2 may remove the rod products contained therein and return the container 2, as well as the partition members 58, 60, 62, and 64 contained therein, back to the original point of transportation for re-use. This capability provides for a significant reduction of waste generated by disposable type containers and thus serves as a countermeasure to environmental pollution.

Moreover, by structuring the side walls 14 and 16 as foldable or deconstructive panels, the container 2 may be reduced in size for transportation back to the original sender and thus provide means for reducing return transportation costs.

Furthermore, the structure of container 2 specified by this embodiment allows the installed positions of the partition members 58, 60, 62, and 64 to be mutually offset in the longitudinal direction of rods 4*a* and 4*b* within the container, thus allowing for the installation and offset positioning of partition members 58, 60, 62 and 64 in the vertical direction 'Z' to serve as the only mechanism by which the aforesaid rods are secured within container 2, even in cases where the rods 4*a* or 4*b* of various diameters are loaded. Moreover, both the upper and lower circumference of rods 4*a* and 4*b* are supported through a wedge compression effect applied by the cutout sections of the partition members, so that the mechanism effectively prevents any movement of the rods 4*a* or 4*b* within the container 2.

The embodiment of the invention explained above is not the only possible embodiment, as those familiar with the art may construe other like structures which still fall within the scope of the invention.

As an example of other embodiments which may be specified within the scope of the invention, while FIG. 1 shows the invention as incorporating three locations for partition member insertion extending in the longitudinal direction 'X' along the first side wall 14 within container 2, four or more partition member insertion locations may be employed as required. Moreover, while the embodiment presented above provides for the use of four partition members (58, 60, 62, and 64) in mutually offset installation positions, two, three, or five or more partition members may be employed as necessary.

Also, there is no specific limit to the number of support cutout grooves 80 and 82 formed along the transverse direction 'Y' of the partition members 58, 60, 62, and 64.

Moreover, the cargo transported within container 2 is not limited to the monocrystalline silicon rods mentioned previously, but may take the form of other rod-shaped cargo as well.

The rod transport container of the present invention provides for re-use of the container, after the rod cargo has been removed, through transportation of the container and partition members contained therein back to the original point of transportation. Resultingly, the amount of waste is eliminated or significantly reduced to the minimum, thus allowing the invention to be employed as a countermeasure to environmental pollution.

To explain more specifically, due to a structure which allows the container's side walls to be mounted to the pallet through a foldable and/or deconstructive mechanism, the height of the container can be reduced for transport back to the original point of transportation, thus lowering transport costs.

Moreover, the container specified by the invention, when used as a transport container, is capable of securely supporting rods of various diameter through a mechanism comprised only of oppositely facing offset partition members which fixedly maintain the lower and upper circumference of the rods through a wedge-type support structure, thus preventing the movement of the rods within the container.

What is claimed is:

1. A rod transport container, comprising:

a first partition member removably insertable into said container, said first partition member incorporating at least one first layer lower support cutout for supporting a lower circumference of at least one first layer rod loaded within said container;

a second partition member removably insertable into said container, said second partition member incorporating at least one first layer upper support cutout for supporting an upper circumference of the at least one layer rod;

said first partition member and said second partition member being removably insertable into said container in mutually offset positions along a longitudinal direction of the at least one rod to be loaded within said container; and a pair of mutually facing side plates having respectively a first slide channel and a second slide channel which are located adjacently and substantially parallel on each inner wall surface of said side plates, both ends of said first partition member being inserted into each of said first slide channels and both ends of said second partition member being inserted into each of said second slide channels.

2. The container as, set forth in claim 1, wherein said first layer lower support cutout provides at least two points of support for the lower circumference of a smallest diameter rod to be loaded within said container.

3. The container as set forth in claim 2, wherein said first layer lower support cutout is formed as a cutout section having inclined obtuse angular surfaces connected by a flat bottom surface, or a V-shaped cutout section.

4. The container as set forth in claim 1, wherein said first layer upper support cutout provides a at least two points of support for the upper circumference of a largest diameter rod to be loaded within the container.

5. The container as set forth in claim 4, wherein said first layer upper support cutout is formed as a cutout section having inclined obtuse annular surfaces connected by a flat bottom surface, or a V-shaped cutout section.

6. The container as set forth in claim 1, wherein multiple first layer lower support cutouts are formed within an upper edge and along the length of said first partition member, and multiple first layer upper support cutouts are formed within a lower edge and along the length of said second partition member oppositely facing said first layer lower support cutouts.

7. The container as set forth in claim 6, wherein second layer lower support cutouts are formed on an upper edge of said second partition member to the same configuration as said first layer lower support cutouts.

8. The container as set forth in claim 7, wherein said second layer lower support cutouts support respectively lower circumferences of second layer rods loaded within said container.

9. The container as set forth in claim 8, wherein second layer upper support cutouts formed on a lower edge of a third partition member hold respectively upper circumferences of the second layer rods.

10. The container as set forth in claim 9, wherein said second layer upper support cutouts are formed to the same shape as said first layer upper support cutouts.

11. The container as set forth in claim 7, wherein third layer lower support cutouts are formed on an upper edge of said third partition member to the same configuration as the first layer lower support cutouts.

12. The container as set forth in claim 11, wherein said third layer lower support cutouts support respectively lower circumferences of third layer rods.

13. The container as set forth in claim 12, wherein third layer upper support cutouts formed on a lower edge of a fourth partition member hold respectively upper circumferences of the third layer rods.

14. The container as set forth in claim 13, wherein said third layer upper support cutouts are formed to the same shape as said first layer upper support cutouts.

15. The container as set forth in any one of claims 6–14, wherein said partition members contacting each rod from upper and lower direction are inserted to and supported by mutually different slide channels so that each rod is supported by the different positioned partition members in the longitudinal direction of the rod.

16. The container as set forth in any one of claims 6–14, wherein a securing device is removably installed in said container for fixedly securing a topmost partition member to said container after the desired number of rods have been loaded.

* * * * *